US005983587A

United States Patent [19]

Limonad

[11] Patent Number: 5,983,587

[45] Date of Patent: Nov. 16, 1999

[54] PLASTER REPAIR DEVICE AND METHOD

[75] Inventor: Alexander Limonad, 9841 Arbor Oaks La.,#206, Boca Raton, Fla. 33428

[73] Assignee: Alexander Limonad, Boca Raton, Fla.

[21] Appl. No.: 09/013,338

[22] Filed: Jan. 26, 1998

[51] Int. Cl.[6] ..... E04B 2/00

[52] U.S. Cl. ..... 52/514

[58] Field of Search ..... 52/514

[56] References Cited

U.S. PATENT DOCUMENTS 3,325,955 6/1967 Haut ..... 52/514

4,578,854 4/1986 Demeglio ..... 29/402.18

*Primary Examiner*—Christopher T. Kent

*Assistant Examiner*—Nkeisha J. Maddox

*Attorney, Agent, or Firm*—Renner, Otto, Boisselle & Sklar, P.L.L.

[57] ABSTRACT

A plaster hole restoration insert employs a shield which opens as an umbrella once inserted through a hole in a wall and which is propped or jacked against the interior of the wall with the hole by a ratchet type jack extending through a hub in the center of the shield and bearing against the opposite side of the wall. The shield may be trimmed to fit, or more than one shield may be employed for a larger hole. The shield has hinged fingers projecting from the hub with a flexible membrane or sheet extending between the fingers. The fingers are limited in their hinging movement to provide a backstop for plaster restoration of the hole. A removable handle is provided to facilitate the propping of the insert against the interior of the hole.

16 Claims, 4 Drawing Sheets

PLASTER REPAIR DEVICE AND METHOD

DISCLOSURE

This invention relates generally as indicated to a plaster or plaster board repair device or insert and method, and more particularly to an interior backstop which can quickly be inserted into a hollow wall to facilitate the plaster restoration of a hole.

BACKGROUND OF THE INVENTION

Most walls built are hollow. A typical interior wall is formed with wood or metal stud framing on certain centers with large sheets of gypsum or plasterboard secured to the framing. The seams in the board are taped and finished, and the wall is then painted or papered. Ceilings may be formed by boards secured to rafters and finished in the same way.

Holes are sometimes made in such walls or surfaces, such as by a door knob punch out, other accidents, or even maliciously. While small holes such as those used for picture hooks are easy to repair, larger holes or punchouts are not.

There are two generally employed methods of repairing such larger holes. One is to secure a tape-like patch over the hole and then smooth a plaster compound or grout over the patch. When it dries, the wall is repainted or papered. Unfortunately, the spot soon becomes visible. The repair spot also cannot withstand any contact pressure. It is so weak, a person could put a finger through the wall, and any significant contact distorts the wall and finish. Such repair systems simply are not a restoration of the wall or surface. They are cosmetic and of short life.

Another repair system is to remove or cut out a section of the board which includes the hole and replace it with a sized cut section spanning the centers of adjoining studs. The replacement section is usually rectangular having a width dictated by the stud centers and a height dictated by the size of the hole. When the repair section is in place, the seams are taped and troweled as with the installation of new board. While the seams along the stud centers are generally reliable because of the stud support, the seams spanning the studs are not. Any pressure against the insert section will soon make the top and bottom or spanning seams visible distortions marring the appearance of the wall.

The most desirable way to repair walls would be to restore the gypsum or plaster material to the hole. While plaster can be applied with a trowel or spatula to smooth over the wall surface, the hollow nature of the wall makes this impractical. Without an interior plug, form, or backstop, the plaster would literally fill the hollow wall cavity and entomb anything inside the wall such as wiring or outlet boxes.

SUMMARY OF THE INVENTION

A gypsum plaster wallboard hole repair insert employs a shield which opens as an umbrella once inserted through a hole in a wallboard and which is propped or jacked against the interior of the wall with the hole by a ratchet type jack extending through a hub in the center of the shield and bearing against the opposite side of the wall. The shield may be trimmed to fit, or more than one shield may be employed for a larger hole. The shield has hinged fingers projecting from the hub with a flexible and elastic or mesh membrane extending between the fingers. The fingers are limited in their hinging movement to provide a backstop for plaster repair of the hole.

To the accomplishment of the foregoing and related ends, the invention then comprises the features hereinafter fully described and particularly pointed out in the claims, the following description and the annexed drawings setting forth in detail certain illustrative embodiments of the invention, these being indicative, however, of but a few of the various ways in which the principles of the invention may be employed.

DETAILED DESCRIPTION OF THE PREFERRED EMBODIMENTS

Figure 1:
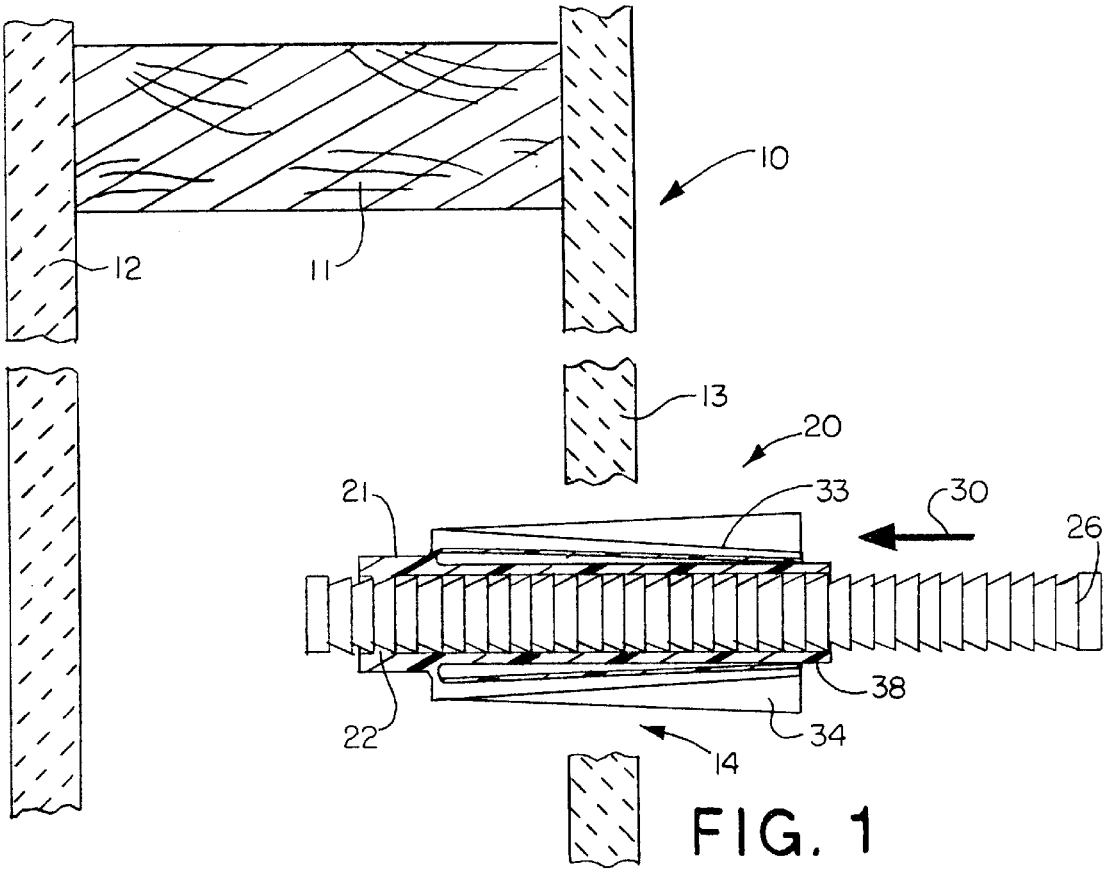
FIG. 1 is a fragmentary section through a hollow wall hole illustrating an insert of the present invention axially folded and in the process of being inserted into the hole.
Figure 2:
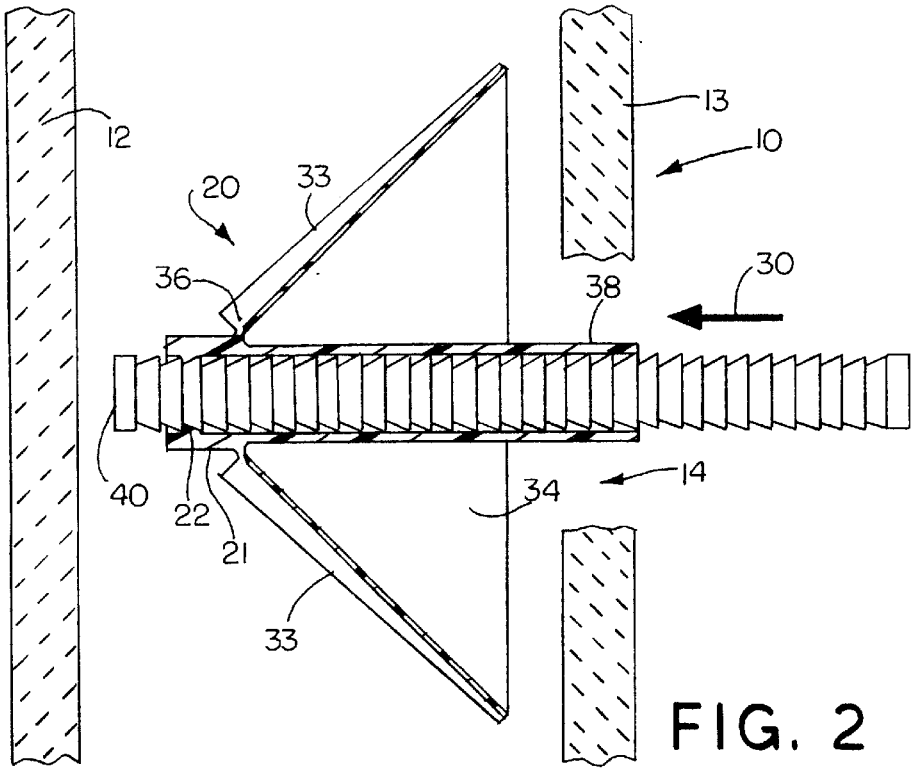
FIG. 2 is a similar section illustrating the insert partially expanded within the wall.

Referring initially to FIGS. 1 and 2 there is illustrated a hollow wall shown generally at 10 which includes studs indicated at 11. Gypsum boards 12 and 13 are secured to the faces of the studs forming the typical hollow wall construction. If a ceiling, the gypsum board sheets would be secured to overhead rafters. If an exterior wall, exterior siding would be secured to one side of the wall and the wall would normally be insulated.

The stud 11 may be a typical wood or metal stud. If a wooden stud, it would be a typical two-by-four with the long dimension forming the interior open space of the wall being approximately 3½. inches wide. Thus there is approximately 3½ inches between the interior of the two opposite wallboards. The plaster or gypsum boards are secured to the studs by nails or screws. It will be appreciated that both metal and wood studs may have different sizes, and the center spacing may vary.

Figure 4:
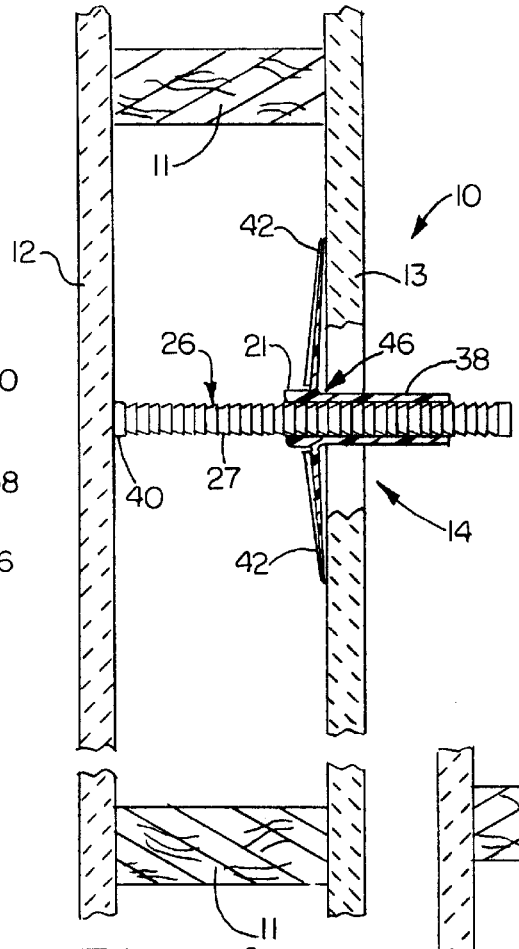
FIG. 4 is a section similar to FIG. 2 illustrating the shield fully expanded and propped or jacked against the interior of the wall.

FIGS. 1, 2 and 4 illustrate a hole 14 punched in the wallboard 13, and it is that hole which needs to be restored with the device and method of the present invention. In order to practice the present invention, an insert or shield shown generally at 20 is employed for insertion in the hole.

Figure 3:
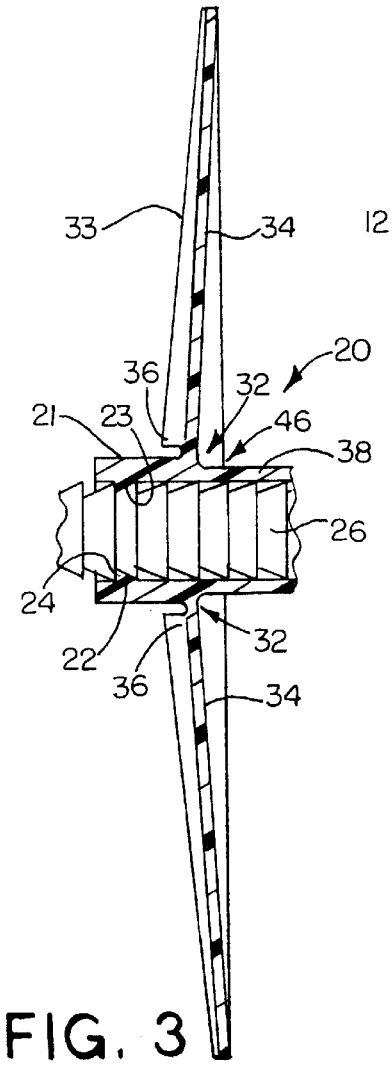
FIG. 3 is an enlarged fragmentary section of the hub of the insert.

Referring now to FIGS. 1, 2 and 3, it will be seen that the insert 20 includes a plastic hub 21 in cylindrical form which includes an annular ratchet tooth 22 on the interior thereof. The ratchet tooth has a sloping surface 23 and a radially extending stop shoulder 24. Projecting through the hub is a jack rod 26 which includes equally spaced slopping grooves 27 designed to mate with the ratchet tooth 22 on the interior of the hub. In this manner, the jack rod may be pushed in the direction of the arrow indicated at 30 with respect to the hub 21, but movement in the opposite direction is precluded.

Figure 6:
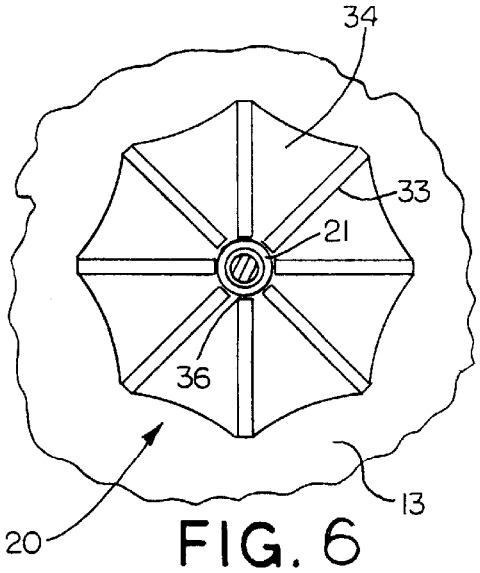
FIG. 6 is a transaxial section from the interior as taken from the line 6—6 of FIG. 5.

Hinged to the hub at 32 are a series of radially projecting tapering fingers 33. As illustrated in FIG. 6, the fingers 33 are eight in number and equally spaced circumferentially about the axis of the hub. This positions the fingers at every 45°. It will be appreciated that more than eight fingers may be employed, but the fingers are preferably equally circumferentially spaced.

Also hinged to the hub at the location 32 is a membrane or web 34 which may be integrally formed with the underside of the fingers and with the hub. The web is relatively thin and elastic, and the web or membrane itself may form the hinge between the proximal end of the fingers and the hub. The web may also be in the form of a fine mesh sufficient to contain the consistency of plaster.

As illustrated more clearly in FIG. 3, the fingers are enlarged at their proximal end as indicated at 36. This enlargement provides a shoulder projecting from the flexible hinge portion which would normally engage the exterior of the hub, preventing the fingers from pivoting or hinging about the hinge point significantly beyond 90°. Also limiting the opening of the fingers is the elasticity of the web or membrane. The elasticity of the web or membrane is designed to provide a neutral force at approximately a 45° angle to the axis of the hub. The elasticity of the web would normally, absent external force, cause the web naturally to move to that intermediate angled position. Thus, when the fingers move beyond the 45°, the web exerts a tension or resistance to the opening of the fingers. The shoulders on the proximal end of the fingers provide the stops limiting the fingers from moving significantly beyond the 90° open position such as seen in FIGS. 3 and 4, and to resist the umbrella shield from turning inside out. Extending axially from the hub 21 is a thinner wall cylindrical handle 38 which allows the user to manipulate the hub as well as the projecting jack rod.

In FIG. 1, the fingers are shown folded flat against the handle 38, and the web or membrane 34 folds between the fingers much like an umbrella. In the folded condition seen in FIG. 1, the insert may readily be inserted through the hole 14 into the interior of the wall. Once inside the wall, as seen in FIG. 2, the fingers 33 move to the open or angled position seen, there being sufficient clearance in the interior of the wall to permit this opening movement.

The installer then grasps the handle 38 as well as the jack rod and relatively moves the jack rod with respect to the hub in the direction of the arrow 30. By pushing the jack rod toward the interior of the opposite wallboard 12, the insert or shield is jacked into the open position seen in FIGS. 3, 4 and 6.

As seen in FIG. 4, the tip 40 of the jack rod engages the opposite interior wall of the open wall and props or jacks the periphery of the shield against the interior of the wall 13 around the opening 14. Pressure created by the relative movement of the jack rod and hub provides a jacking pressure around the periphery of the shield against the interior of the wallboard 13 as indicated at 42.

Figure 5:
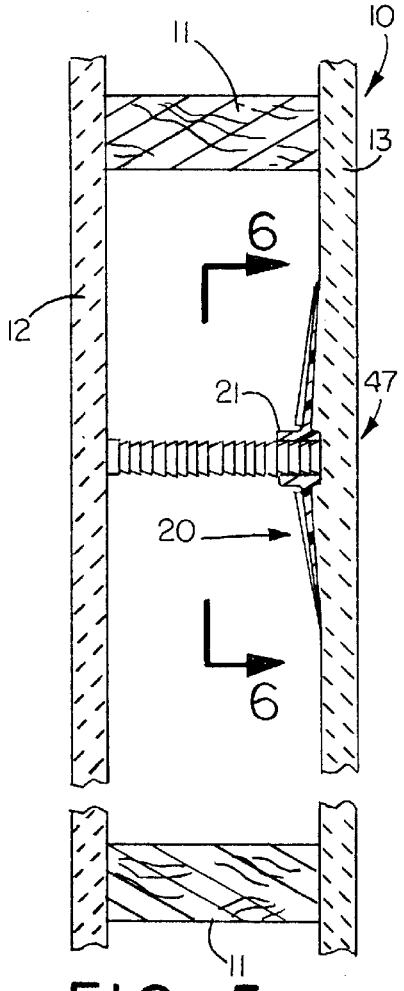
FIG. 5 is a view similar to FIG. 4 illustrating any projecting portions trimmed and the plaster repair made.

As seen in FIG. 4, the handle 38 as well as the end of the jack rod may project outwardly of the hole 14. The projecting portion of both may be simply snipped or broken off as indicated at 46 in FIG. 5 or FIG. 3. Alternatively, the jack rod may be of a length to fit the wall board spacing so that only the handle needs to be snipped or broken off. At this point, the hole is provided with a backstop, and a plaster restoration of the hole may quickly be made using the shield as the backstop. The propped shield remains in place. As illustrated in FIG. 5, the hole has been repaired, and the area of the wall 13 indicated at 47 has been restored.

Figure 7:
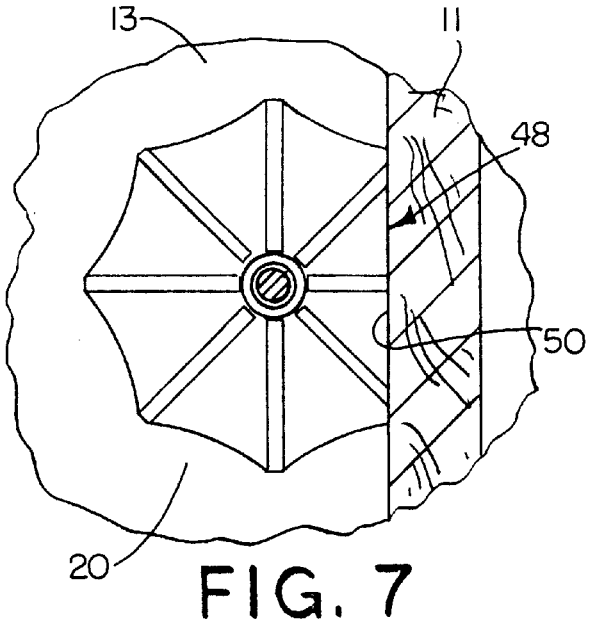
FIG. 7 is a view like FIG. 6 but illustrating how the shield can be trimmed to accommodate a stud or other obstruction.

Referring now to FIG. 7, it will be seen that if the hole is too close to a stud 11, the shield may simply be trimmed as indicated at 48 to fit against the side of the stud shown at 50.

Figure 8:
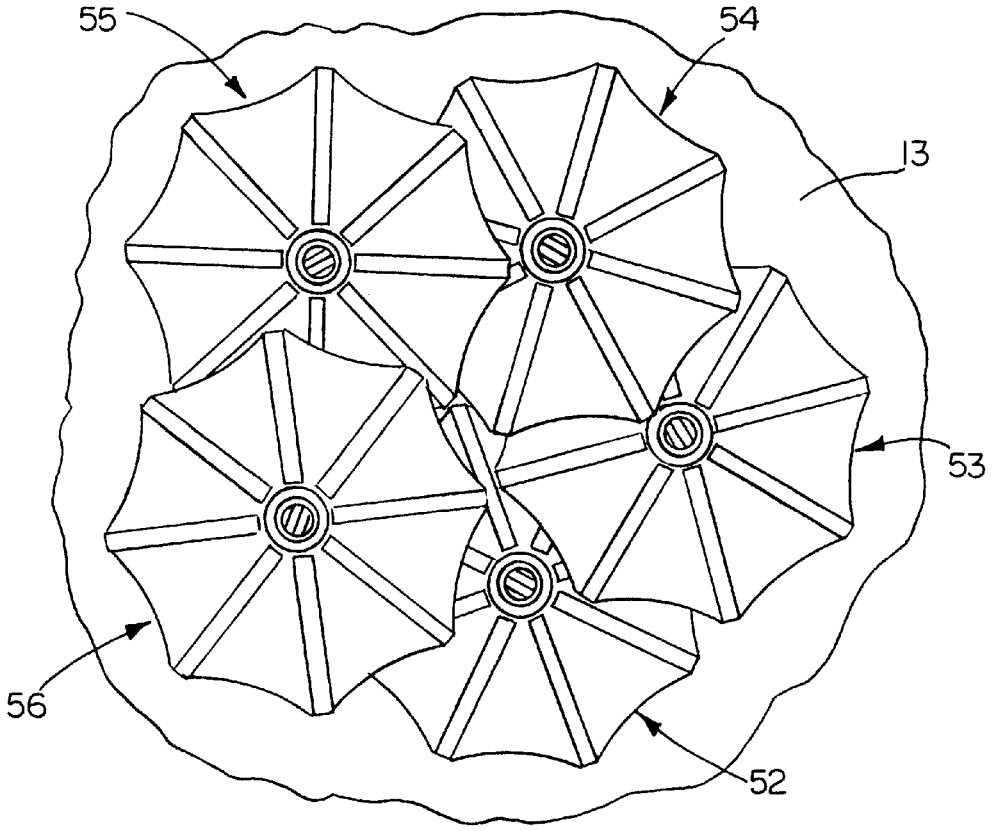
FIG. 8 is a schematic illustration of how more than one shield or insert can be employed to restore a larger hole.
Figure 9:
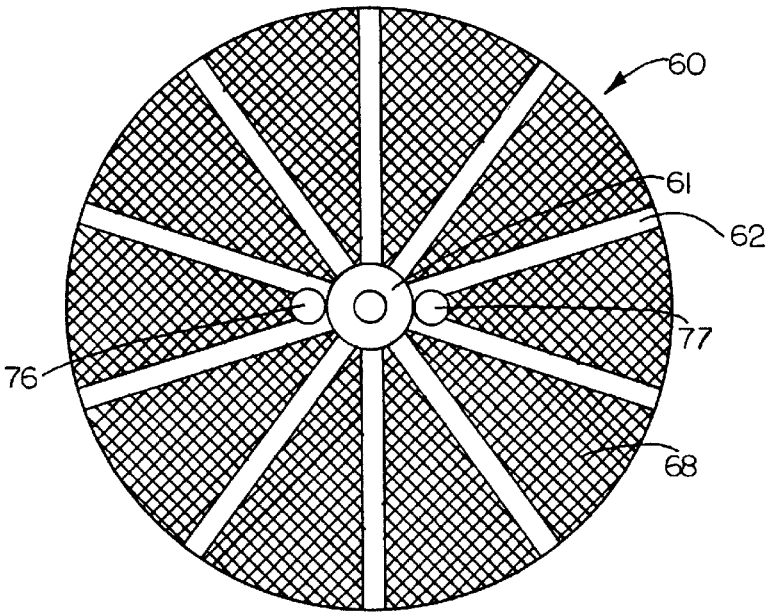
FIG. 9 is a transaxial view of another form of umbrella-like backstop open.

With reference to FIG. 8, there is illustrated a total of five inserts or shields shown at 52,53,54,55, and 56 inserted through a somewhat larger hole in the gypsum or wallboard 13. As indicated, when opened, the shields or inserts may overlap each other, and in the aggregate, form a backstop or shield which embraces the interior of the hole to be restored. A plaster restoration of the wallboard may then be undertaken utilizing the overlapping shields or inserts as illustrated.

Referring now to FIGS. 9–12, there is illustrated another embodiment of the invention. The shield or insert shown generally at 60 includes a central hub 61 and equally spaced radially extending arms 62. In this embodiment, the arms are ten in number and accordingly spaced 36° apart. The arms are hinged to the hub in the same manner and include proximal shoulders 65 which limit the opening of the arms to the radial position seen in FIGS. 9 and 10. The circular sheet or web 66 connecting and spanning the fingers may be in the form of a relatively fine mesh as seen at 68, sufficient to contain the consistency of plaster.

Figure 12:
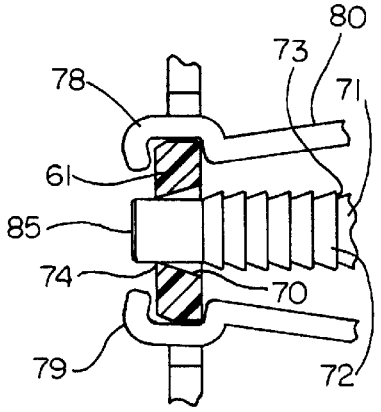
FIG. 12 is an enlarged fragmentary section of the releasable connection between the handle and the insert or shield.
Figure 10:
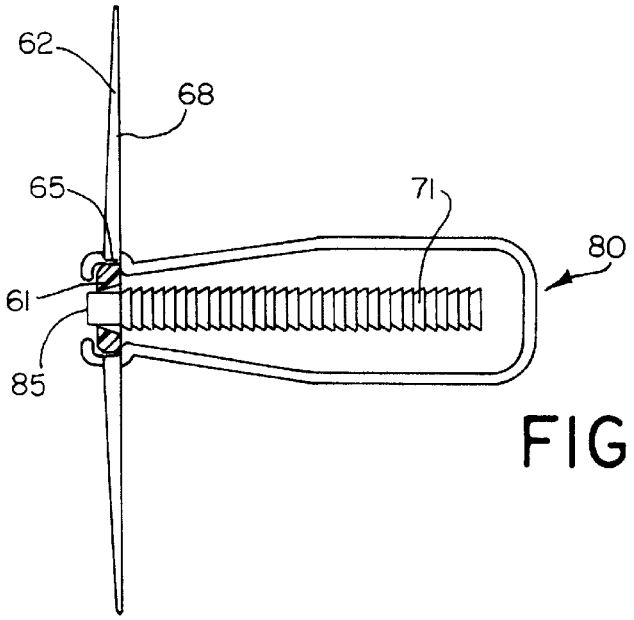
FIG. 10 is an elevation of the embodiment of FIG. 9 showing a removable handle in place.
Figure 11:
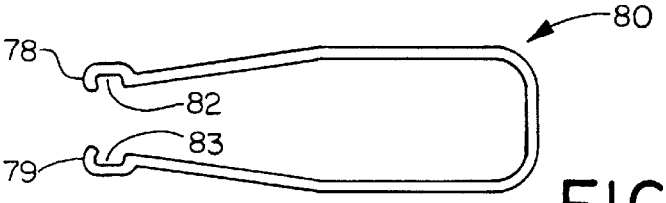
FIG. 11 is an elevation of the handle alone.

The interior of the hub is provided with a tapered hole 70 which accommodates jack rod 71. The jack rod has equally spaced sloping ridges 72 forming stop shoulders 73. Once pushed to the left, as seen in FIGS. 10 and 12, through the narrow end 74 of opening 70, the rod cannot retreat. The ratchet system enables the insert to be quickly propped in place.

Positioned adjacent the hub 61 are two diametrically positioned relatively small holes 76 and 77. The holes extend through the mesh and a portion of the adjacent fingers. The holes are only large enough to accommodate the hooked ends 78 and 79 of a U-shape handle 80. The hooked ends provide interior notches 82 and 83 which enable the hub to be grasped to be pushed or pulled as seen more clearly in FIGS. 10 and 12. The handle will be installed on the insert when opened and may be used to push the insert through the hole 14. The arms and membrane will then simply fold back on the handle. When the insert or shield is inside the wall and has started to expand behind the hole, the handle may then be used to pull on or hold the hub while the jack is inserted through the hole so that the tip 85 engages the interior of the far wall, propping the insert open and against the inside of the hole. The jack may be dimensioned so that it does not project. The handle is then removed, and the hole is ready for repair.

As illustrated, the handle preferably is a one-piece molded plastic bail, and the hook ends may be manipulated by squeezing or releasing the handle. The handle may be discarded or reused.

It can now be seen that there is provided a plaster wallboard hole repair insert for a hollow wall system which includes an expansible shield capable of expanding as an umbrella from a folded axially compressed condition as seen in FIG. 1 for insertion through a hole to an expanded radially extending condition once inside the hollow wall system. A means to jack the shield against the inside of the hole once inserted is provided which also props the shield against the interior of the opposite wallboard. There is, of course, also disclosed a method of fixing a hole in a plaster wallboard which comprises the steps of inserting the flexible shield into the hole to expand within the wall as an umbrella, and then propping the shield open against the interior of the plaster wallboard hole with the shield embracing the interior of the hole and serving as a backstop for plaster restoration. The insert and method will, of course, work as well in a conventional plaster wall.

To the accomplishment of the foregoing and related ends, the invention then comprises the features particularly pointed out in the claims, these being indicative, however, of but a few of the various ways in which the principles of the invention may be employed.

I claim:

1. A plaster wall hole repair insert for a hollow wall system comprising an expansible shield capable of expanding as an umbrella from a folded axially compressed condition for insertion through a wall hole to an expanded radially extending condition once inside the hollow wall system, and ratcheting jack means insertable axially through the shield to jack the shield against the inside of the hole once inserted and radially extended to close the interior of the hole for plaster restoration of the hole, said ratcheting jack means engaging the interior of the opposite side of the hollow wall system to prop and force the shield when expanded against the interior of the wall with the hole.

2. A repair insert as set forth in claim 1 wherein said repair insert includes a hub with axially foldable fingers extending normally generally radially from the hub, and a flexible sheet extending between said fingers.

3. A repair insert as set forth in claim 2 wherein the periphery of the sheet and fingers when extended is generally circular.

4. A repair insert as set forth in claim 3 wherein the length of the finger is less than the interior dimension of the wall, and said sheet is generally elastic.

5. A repair insert as set forth in claim 2 including an axially extending removable handle to hold the shield as the jack means is inserted and extended to engage the interior of the opposite side of the hollow wall system.

6. A repair insert as set forth in claim 2 wherein said sheet is a fine mesh.

7. A method of restoring a hole in a wall in a open wall system comprising the steps of inserting a flexible shield into the hole to expand within the wall, inserting a ratcheting jack axially of the shield, propping the shield open against the interior of the hole, removing any projecting part, and then restoring the hole with plaster using the shield as a backstop.

8. A method as set forth in claim 7 including the step of trimming the shield to clear possible obstructions inside the wall.

9. A method as set forth in claim 7 including the step of using multiple shields to restore a hole larger than a single shield.

10. A method as set forth in claim 7 wherein the propping step includes inserting a jack axially through the shield to engage the opposite interior of the wall.

11. A method as set forth in claim 10 wherein the jack and shield interfit to limit relative movement to insertion of the jack only.

12. A method as set forth in claim 7 including the step of providing the shield with hingeable fingers interconnected by a flexible sheet.

13. A method as set forth in claim 12 including the step of limiting the hinging of the finger to about 90°.

14. A method as set forth in claim 7 including the step of holding the shield with a removable handle to facilitate the propping of the shield against the interior of the hole.

15. A plaster wall hole repair insert for a hollow wall system comprising an expansible shield capable of expanding as an umbrella from a folded axially compressed condition for insertion through a wall hole to an expanded radially extending condition once inside the hollow wall system, and means to jack the shield against the inside of the hole once inserted and radially extended to close the interior of the hole for plaster restoration of the hole, said jack means engaging the interior of the opposite side of the hollow wall system and forcing the shield when expanded against the interior of the wall with the hole, and said repair insert includes a hub with axially foldable fingers extending normally generally radially from the hub, and a flexible sheet extending between said fingers, the periphery of the sheet and fingers when extended being generally circular, and wherein the length of the fingers is less than the interior dimension of the wall, and said sheet is generally elastic, said jack means fitting in and extending through said hub to engage the interior of the opposite side of the wall, and ratchet means to hold the jack means in place when thus inserted and extended.

16. A plaster wall hole repair insert for a hollow wall system comprising an expansible shield capable of expanding as an umbrella from a folded axially compressed condition for insertion through a wall hole to an expanded radially extending condition once inside the hollow wall system, and means to jack the shield against the inside of the hole once inserted and radially extended to close the interior of the hole for plaster restoration of the hole, an axially extending removable handle to hold the shield as the jack means is inserted and extended to engage the interior of the opposite side of the hollow wall system, said handle being a one-piece plastic bail adapted to hook on the shield.

* * * * *